US007937778B1

(12) United States Patent
Norton

(10) Patent No.: US 7,937,778 B1
(45) Date of Patent: May 10, 2011

(54) PROTECTIVE HEADGEAR

(75) Inventor: John K. Norton, Avon Lake, OH (US)

(73) Assignee: No Problem, Inc., Avon Lake, OH (US)

( * ) Notice: Subject to any disclaimer, the term of this patent is extended or adjusted under 35 U.S.C. 154(b) by 724 days.

(21) Appl. No.: 11/498,493

(22) Filed: Aug. 4, 2006

(51) Int. Cl.
*A42B 3/00* (2006.01)

(52) U.S. Cl. ..... 2/414; 2/410; 2/411; 2/209.13; 2/175.4; 2/195.5

(58) Field of Classification Search ..... 2/410, 6.1, 2/6.6, 6.8, 411, 412, 413, 414, 422, 425, 2/10, 171, 171.1, 181, 205, 209.13, 175.1, 2/195.1, 175.4, 202, 195.5, 5, 417, 255; 602/3, 602/5, 6, 9, 10, 17
See application file for complete search history.

(56) References Cited

U.S. PATENT DOCUMENTS

| | | | | | |
|---|---|---|---|---|---|
| 1,705,879 | A | | 3/1929 | Rodgers | |
| 3,133,289 | A | * | 5/1964 | Lipschutz | 2/195.6 |
| 3,197,784 | A | * | 8/1965 | Carlisle | 2/420 |
| 3,843,970 | A | * | 10/1974 | Marietta et al. | 2/415 |
| 4,282,610 | A | | 8/1981 | Steigerwald et al. | 2/414 |
| 5,173,970 | A | | 12/1992 | Shifrin | 2/410 |
| 5,361,420 | A | | 11/1994 | Dobbs et al. | 2/425 |
| 5,365,607 | A | * | 11/1994 | Benevento et al. | 2/181.4 |
| 5,515,546 | A | | 5/1996 | Shifrin | 2/410 |
| 5,544,367 | A | | 8/1996 | March, II | 2/410 |
| 5,661,854 | A | | 9/1997 | March, II | 2/410 |
| 5,724,678 | A | * | 3/1998 | McCallum et al. | 2/209.13 |
| 5,729,830 | A | | 3/1998 | Luhtala | 2/2.5 |
| 5,930,841 | A | | 8/1999 | Lampe et al. | 2/411 |
| 6,023,788 | A | | 2/2000 | McCallum et al. | 2/209.13 |
| 6,154,889 | A | | 12/2000 | Moore, III et al. | 2/418 |
| D439,377 | S | | 3/2001 | Dagan | D29/106 |
| D444,292 | S | * | 7/2001 | Wang | D2/882 |
| 6,397,399 | B1 | | 6/2002 | Lampe et al. | 2/425 |
| D503,260 | S | * | 3/2005 | Kim | D2/865 |
| 6,904,617 | B2 | * | 6/2005 | Tsai | 2/209.13 |
| 7,120,937 | B2 | * | 10/2006 | Monshouwer | 2/171 |
| 2005/0160520 | A1 | * | 7/2005 | Forrest | 2/255 |

* cited by examiner

*Primary Examiner* — Katherine Moran
*Assistant Examiner* — Sally C Cline
(74) *Attorney, Agent, or Firm* — Renner, Kenner, Greive, Bobak, Taylor & Weber

(57) ABSTRACT

A cap (10) is provided with a plurality of pockets (29) formed between a plurality of panels (13-18) and fabric materials (25) attached to each of the panels (13-18). The pockets (29) have an open end which is covered by a headband (23). A protection segment (30) is positioned in each pocket (29) and includes a plastic protective panel (31) and an energy absorbing foam layer (32). The segments (30) are curved in both the longitudinal and lateral directions, but not all of the segments (30) have the same radii of curvature in those directions.

6 Claims, 6 Drawing Sheets

PROTECTIVE HEADGEAR

TECHNICAL FIELD

This invention relates to protective headgear such as might be worn by participants in a sporting event. More particularly, this invention relates to such headgear which takes on the appearance of a conventional cap but which is provided with padded reinforcement.

BACKGROUND ART

Protective headgear of various varieties are worn by participants in many different sporting events. For example, helmets are always worn by those participating in sports such as football and hockey, and a batting helmet is worn by a baseball player when batting or running the bases. These batting helmets can be sized to fit over an existing baseball cap, or can be worn directly on the head, but they are removed when the player takes the field for defensive purposes. However, the baseball player is still at risk of head injury while in the field, but it would not be practical for the cumbersome batting helmet to be worn by all players while in the field. Thus, the need exists for a protective headgear which takes on the configuration and appearance of a conventional cap without impeding the ability of the user to move about with the hat in place.

DISCLOSURE OF THE INVENTION

It is thus an object of the present invention to provide headgear which looks like a conventional baseball cap but which includes protecting sections.

It is another object of the present invention to provide headgear, as above, in which the protection segments are replaceable in the event of breakage.

It is a further object of the present invention to provide headgear, as above, which not only provides protection for the head but which is also padded so as to be comfortable to wear.

It is an additional object of the present invention to provide headgear, as above, in which the protection segments are configured differently so as to more properly fit the user.

These and other objects of the present invention, as well as the advantages thereof over existing prior art forms, which will become apparent from the description to follow, are accomplished by the improvements hereinafter described and claimed.

In general, a cap made in accordance with one aspect of the present invention includes a plurality of interconnected panels adapted to cover a head. A pocket is formed at each panel and a protection segment is received in each pocket. Each segment includes a protective panel and an energy absorbing layer, and the segments are not all of the same configuration.

In accordance with another aspect of the invention, a cap has a plurality of interconnected panels adapted to cover a head, and a pocket having an open end is formed at each panel. A headband covers the open ends but allows access to the pockets so that a protection segment may be received in each pocket. Each protection segment includes a protective panel and an energy absorbing layer.

In another aspect of the present invention, a cap has a plurality of panels adapted to cover a head. A pocket having an open end is formed at each panel. A protection segment is removably receivable in each pocket and includes a protective panel and an energy absorbing layer.

A preferred exemplary protective headgear according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
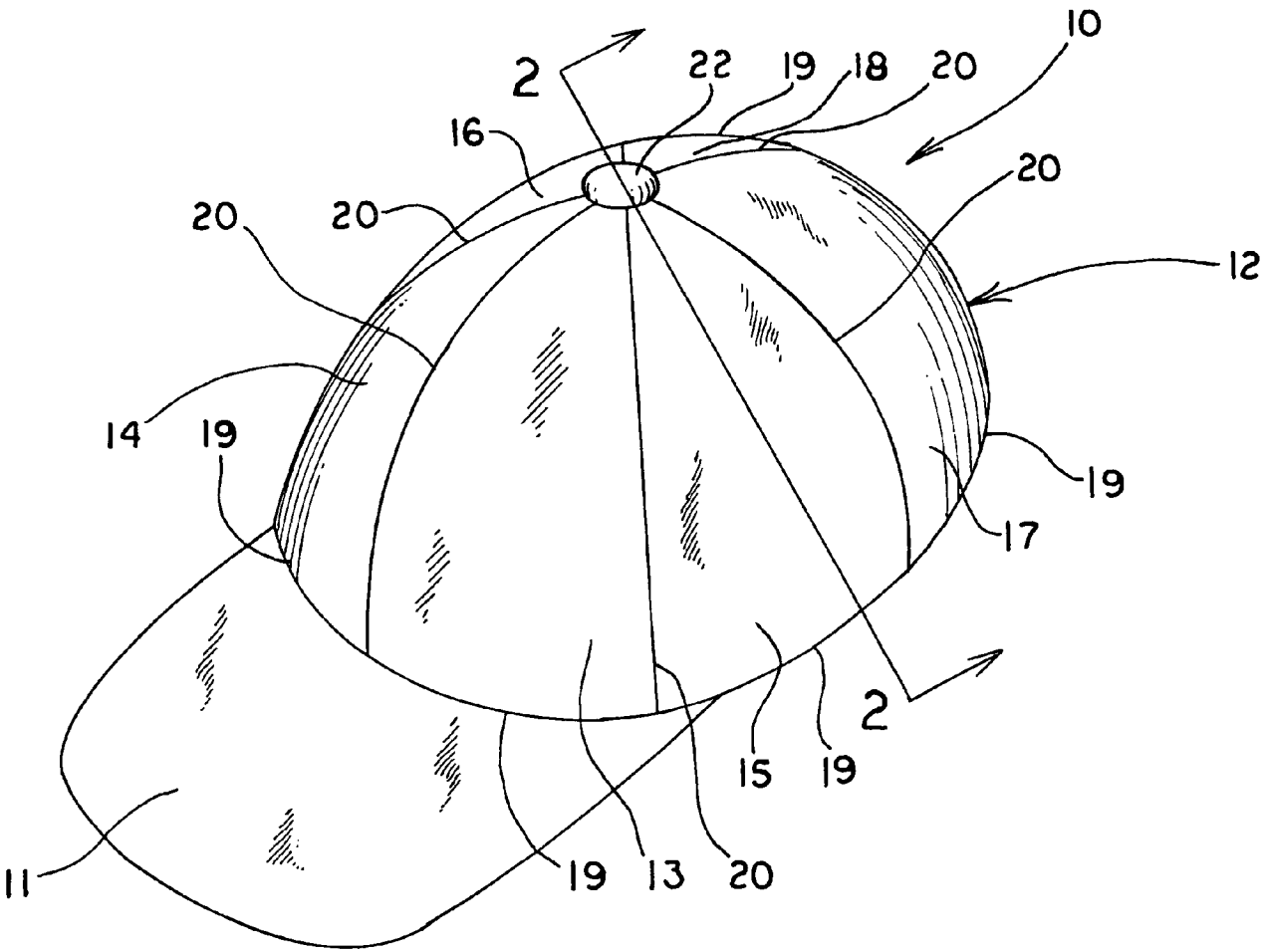
FIG. 1 is top perspective view of a protective headgear according to the concepts of the present invention shown to be in the form of a baseball cap.
Figure 2:
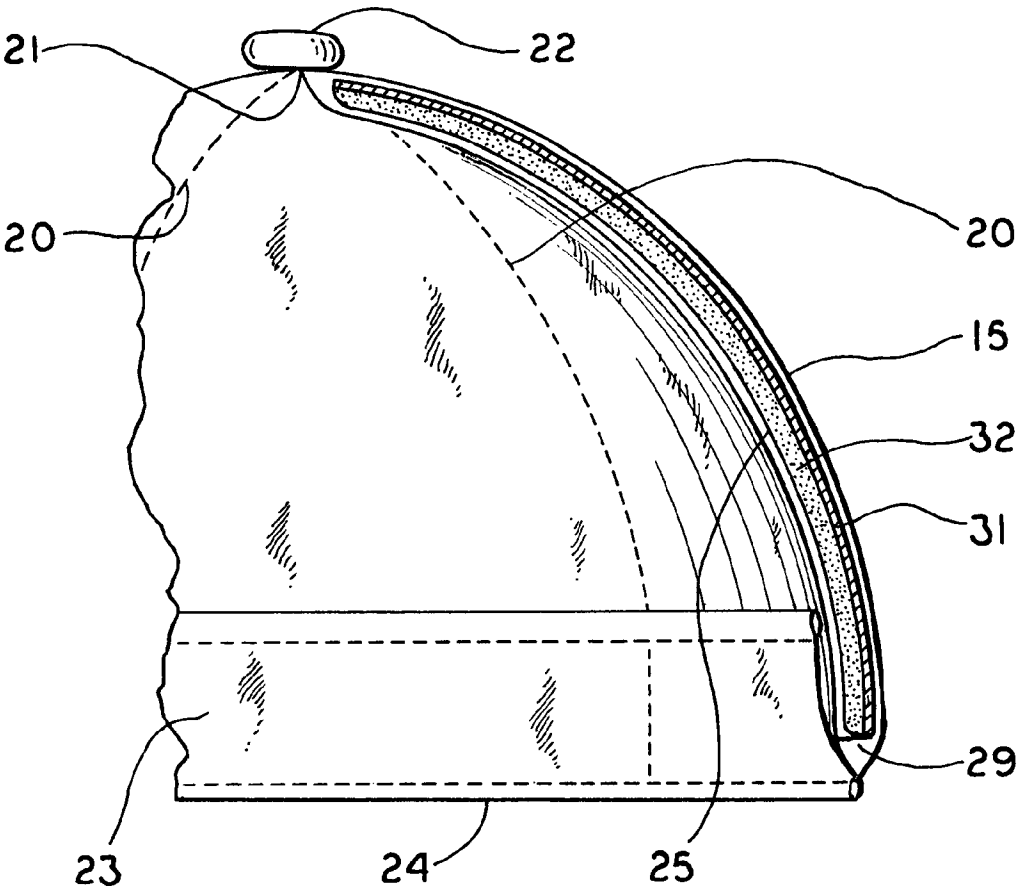
FIG. 2 is a sectional view taken substantially along line 2-2 of FIG. 1.

A protective headgear made in accordance with the present invention is shown in the configuration of a baseball cap and is generally indicated by the numeral 10. Cap 10 includes a conventional, fabric-covered, reinforced bill 11 and a head covering portion generally indicated by the numeral 12. Portion 12 is constructed of a plurality of fabric panels 13, 14, 15, 16, 17 and 18 each generally taking on the shape of an isosceles triangle having a base 19 and opposed sides 20 interconnected at a point 21 (FIG. 2). The sides 20 of adjacent panels 13-18, which may be slightly curved, are attached to each other, as by stitching or the like, and the points 21 of all panels 13-18 may be attached to each other as by a conventional button grommet 22 or the like. The bases 19 of all panels 13-18, which may also be slightly curved, may be attached to a headband 23 (FIG. 2) at the edge 24 thereof. The edge 24 of headband 23 is also attached to bill 11.

Figure 3:
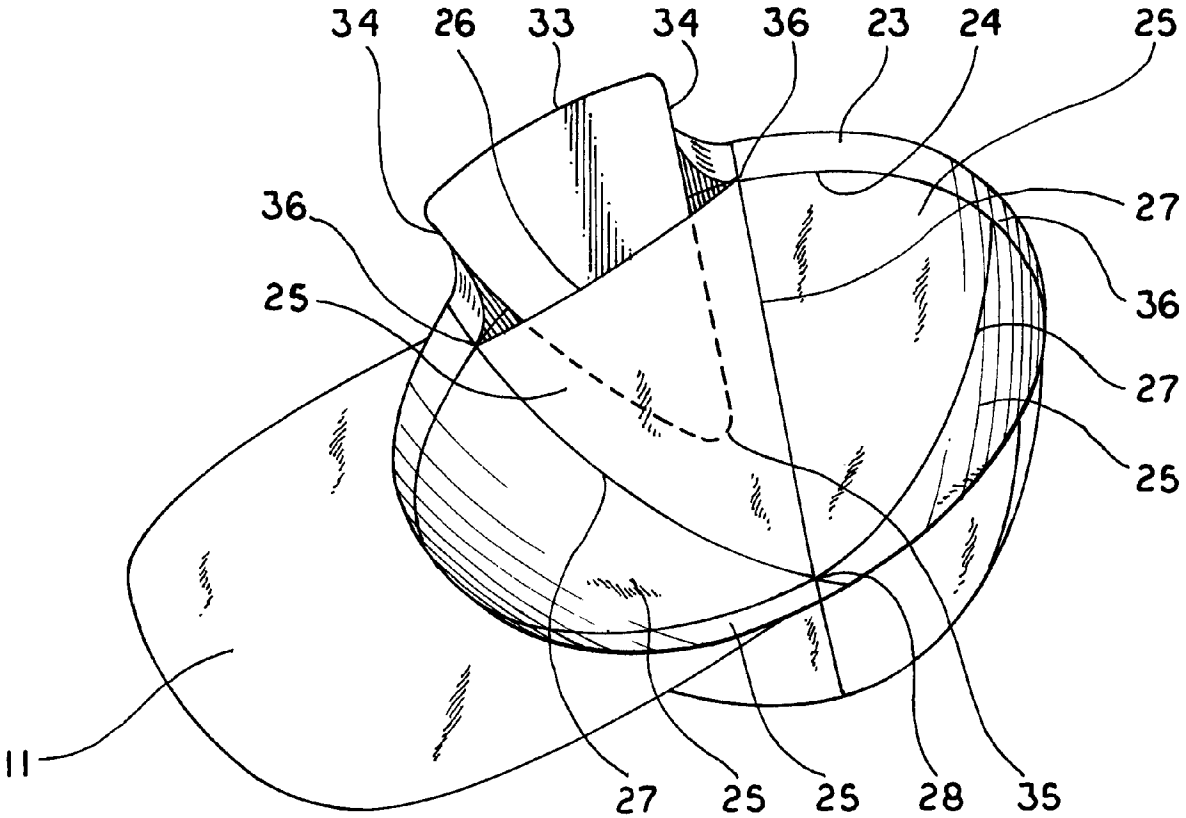
FIG. 3 is a bottom perspective view of the cap of FIG. 1 showing the manner in which a protective panel may be positioned in the cap.

As best shown in FIG. 3, a piece of fabric material 25 is positioned adjacent to each panel 13-18 and is configured generally identical to panels 13-18. Thus, each piece of material 25 generally takes the shape of an isosceles triangle having a base 26 and opposed sides 27 interconnected at a point 28. The sides 27 of each piece of material 25 are attached to panels 13-18 at the location of their sides 20, and point 28 at all pieces of material 25 can be attached to each other and to panels 13-18 at grommet 22. However, the base 26 of each piece of material 25 is not attached to any part of cap portion 12, thus forming the open end of a pocket 29 between material 25 and each panel 13-18. Thus, cap 10 is provided with six pockets 29, and the open end of the pockets 29 is covered by the headband 23.

Each pocket 29 is adapted to receive a protection segment generally indicated by the numeral 30. Each segment 30 is formed with a rigid, sturdy, plastic panel 31 which is preferably formed of any class of plastic based on acrylonitrile, butadiene and styrene copolymers having a thickness of approximately one-eighth inch. Each segment 30 also includes an energy absorbing layer 32 attached to panel 31. Layer 32 may preferably be formed of a high density closed cell foam and can be of approximately one-eighth inch thickness. As shown in the drawings, foam layer 32 may be somewhat thicker than plastic panel 31. Plastic panel 31 is thus designed to resist impacts as might occur if a baseball were to strike it, and foam layer 32 not only absorbs such impacts, but also provides comfort to the head of the user which will not be in direct contact with the hard plastic panel 31.

Segments 30 are configured to generally match the profile of pockets 29, that is, the profile of fabric material 25 and cap panels 13-18. As such, members 30 take on the shape of an isosceles triangle having a laterally extending base 33 and opposed sides 34 extending longitudinally from the ends of the base 33. Sides 34 meet at point 35 which is longitudinally opposite base 33.

The segments 30 are inserted into adjacent pockets 29 as shown in FIG. 3. That is, at the area of an opening to the pocket 29 being filled with a segment 30, headband 23 is pulled away from pocket material 25 and the protection segment can be slid into opposed pocket 29 so that point 35 is adjacent to button 22 and base 33 is within the confines of pocket 29 adjacent base 26 of material 25 and base 19 of a panel 13-18. It should be noted that headband 23 is preferably tack-stitched to materials 25 at the seams thereof, as at 36 in FIG. 2, to maintain headband 23 in its normal position and yet provide access to pockets 29 as just described. In this manner, if one were to want to use cap 10 without the protection segments 30, they can readily be removed, or should a segment 30 break, it can be readily replaced. However, it is also contemplated that headband 23 could be stitched to materials 25 circumferentially all the way around cap 10 thereby more permanently closing pockets 29, and yet still allowing access, as necessary, by severing the applicable stitching.

Figure 4:
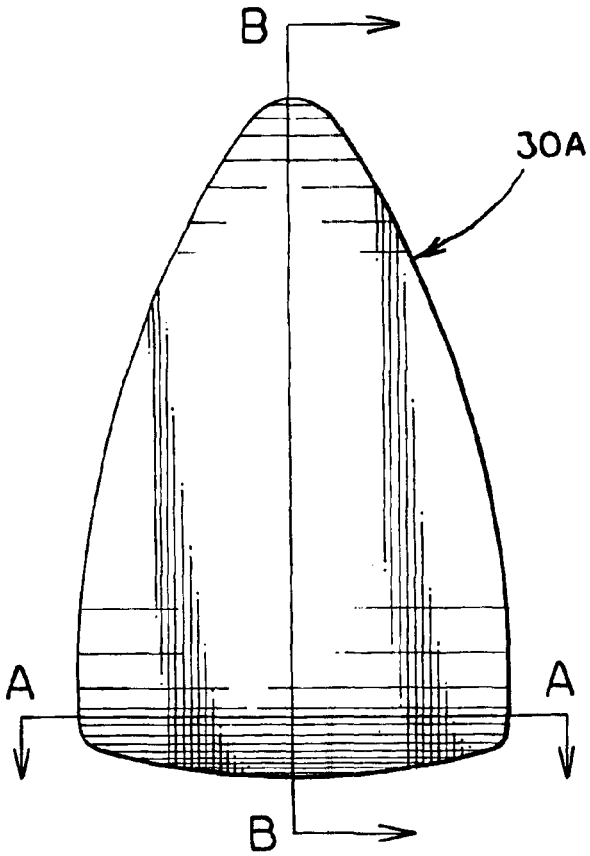
FIG. 4 is an elevational view of a protection panel of one size and configuration.
Figure 5:
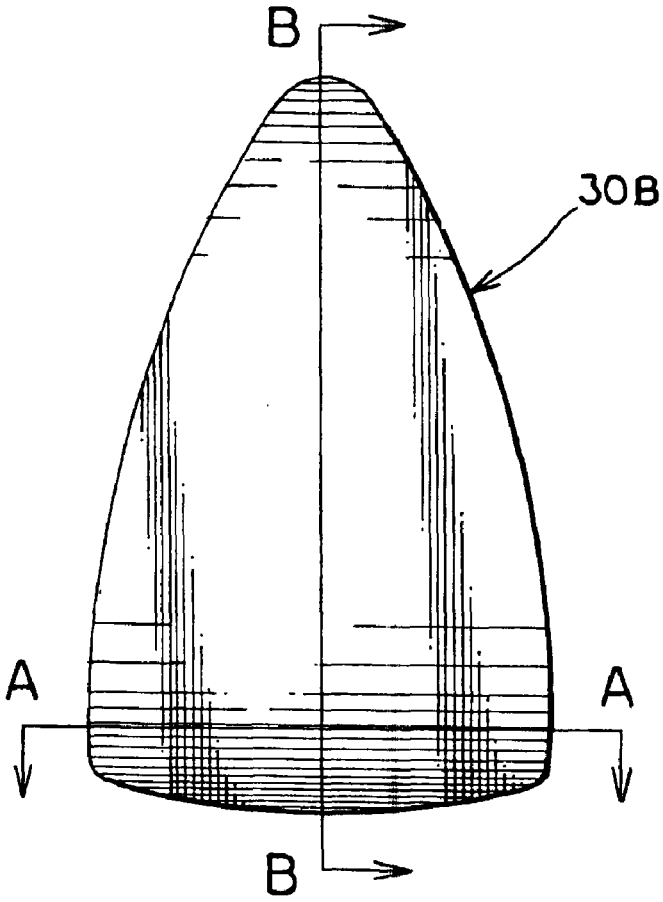
FIG. 5 is an elevational view of a protective panel of a size and configuration different than that of FIG. 4.
Figure 6:
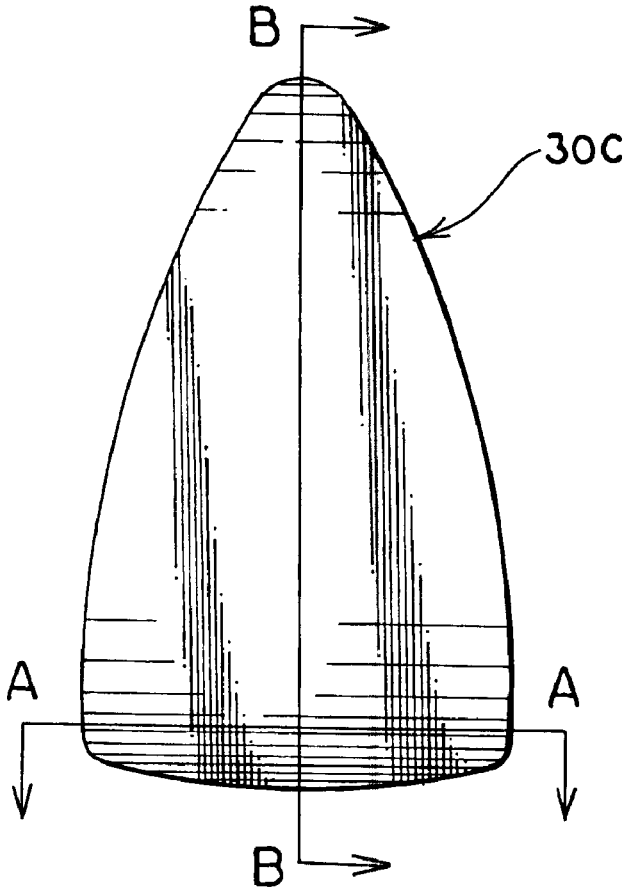
FIG. 6 is an elevational view of a protective panel of a size and configuration different than that of FIGS. 4 and 5.

As best seen in FIGS. 4, 5 and 6, segments 30 are curved both in the longitudinal and lateral directions so that when placed in pockets 29, cap 10 will take on an arcuate configuration generally corresponding to the shape of one's head. While all six segments 30 could be curved identically, it has been found that the shape of a typical head could be better matched, for both comfort and protection purposes, if the segments 30 do not all have the same radii of curvature in the lateral direction, nor the same radii of curvature in the longitudinal direction, as now will be discussed.

Figure 4B:
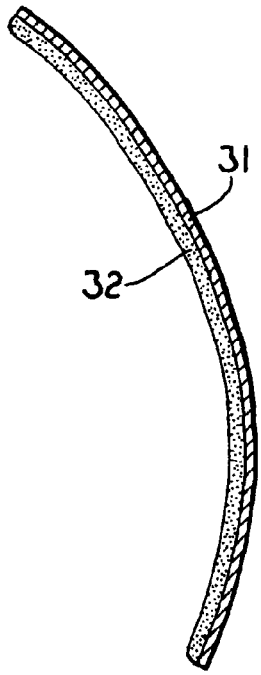
FIG. 4B is a sectional view taken substantially along line B-B of FIG. 4.
Figure 4A:
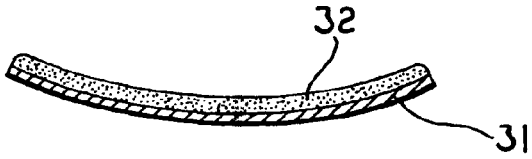
FIG. 4A is a sectional view taken substantially along line A-A of FIG. 4.

The segments 30 received in the adjacent pockets 29 formed at the back of cap 10 between materials 25 and panels 17 and 18 are generally identical and are identified as back segments 30A and shown in FIGS. 4, 4A and 4B. The segments 30 received in the opposed pockets 29 formed in the center of cap 10 between materials 25 and panels 15 and 16 are generally identical and are identified as central segments 30B and shown in FIGS. 5, 5A and 5B. The segments 30 received in the adjacent pockets 29 formed at the front of cap 10 between materials 25 and panels 13 and 14 are generally identical and are identified as front segments 30C and shown in FIGS. 6, 6A and 6B.

Figure 5B:
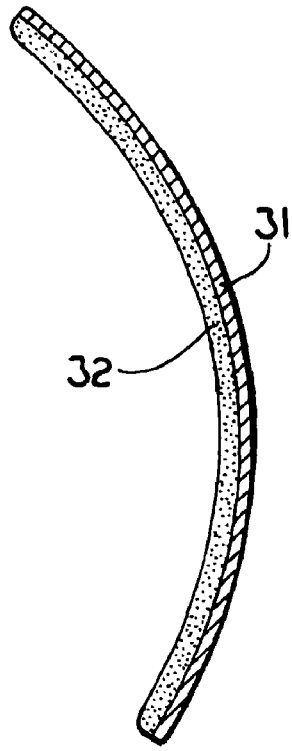
FIG. 5B is a sectional view taken substantially along line B-B of FIG. 5.
Figure 5A:
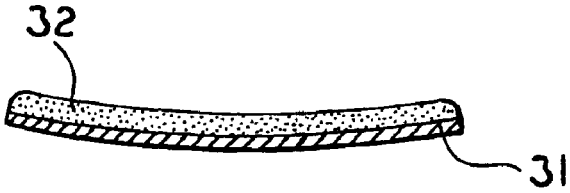
FIG. 5A is a sectional view taken substantially along line A-A of FIG. 5.
Figure 6B:
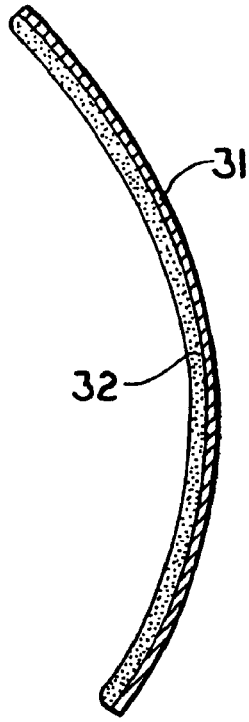
FIG. 6B is a sectional view taken substantially along line B-B of FIG. 6.
Figure 6A:
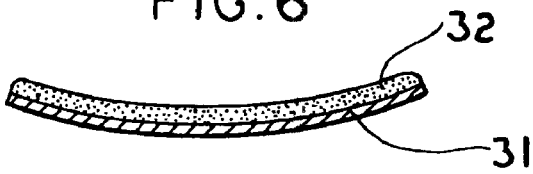
FIG. 6A is a sectional view taken substantially along line A-A of FIG. 6.

Comparing the radii of curvature in the lateral direction, that is, comparing FIGS. 4A, 5A and 6A, it will be noted that the radius of curvature of back segments 30A (FIG. 4A) is the smallest, and the radius of curvature of central segments 30B (FIG. 5A) is the largest. The radius of curvature in the lateral direction of front segments 30C (FIG. 6A) is very similar to, and preferably just slightly larger than, that of back segments 30A.

Comparing the radii of curvature in the longitudinal direction, that is, comparing FIGS. 4B, 5B and 6B, it will be noted that the radius of curvature of back segments 30A (FIG. 4B) is the largest, and the radius of curvature of front segments 30C (FIG. 6B) is the smallest. The radius of curvature in the longitudinal direction of central segments 30B (FIG. 5B) is very similar to, and preferably just slightly larger than, that of front segments 30C.

In view of the foregoing, it should be evident that a cap constructed as described herein will comfortably fit the head of most users while protecting the user from injury, thus accomplishing the objects of the invention and substantially improving the art.

What is claimed is:

1. A cap comprising a plurality of interconnected panels adapted to cover a head; a pocket formed at each said panel, said pockets having an open end; a headband covering said open ends but allowing access to said pockets; and a protection segment adapted to protect a user received in each said pocket, each said protection segment including a protective panel made of a rigid plastic material and an energy absorbing layer made of foam, wherein each said protection segment has a longitudinal extent and a lateral extent, said protection segments being curved in the longitudinal direction and the lateral direction and not all having the same radius of curvature in the longitudinal direction and not all having the same radius of curvature in the lateral direction, wherein there is a front pair of adjacent protection segments which are generally of the same configuration, a central pair of opposed protection segments which are generally of the same configuration and a back pair of adjacent protection segments which are generally of the same configuration, said front, central and back pairs being of different configurations, and wherein said back pair of protection segments have the largest radii of curvature in the longitudinal direction and said front pair of protection segments have the smallest radii of curvature in the longitudinal direction.

2. The cap of claim 1 wherein each said pocket is formed by attaching a piece of fabric material to each said panel, said fabric materials being configured to generally match the configuration of said panels.

3. The cap of claim 1 wherein said headband is attached to said panels at least at the point of interconnection of adjacent panels.

4. A cap comprising a plurality of interconnected panels adapted to cover a head; a pocket formed at each said panel, said pockets having an open end; a headband covering said open ends but allowing access to said pockets; and a protection segment adapted to protect a user received in each said pocket, each said protection segment including a protective panel and an energy absorbing layer, wherein each said protection segment has a longitudinal extent and a lateral extent, said protection segments being curved in the longitudinal direction and the lateral direction, wherein there is a front pair of adjacent protection segments which are generally of the same configuration, a central pair of opposed protection segments which are generally of the same configuration and a back pair of adjacent protection segments which are generally of the same configuration, said front, central and back pairs being of different configurations, wherein said central pair of protection segments have the largest radii of curvature in the lateral direction and said back pair of protection segments have the smallest radii of curvature in the lateral direction, and wherein said back pair of protection segments have the largest radii of curvature in the longitudinal direction and said front pair of protection segments have the smallest radii of curvature in the longitudinal direction.

5. The cap of claim 4 wherein each said pocket is formed by attaching a piece of fabric material to each said panel, said fabric materials being configured to generally match the configuration of said panels.

6. The cap of claim 4 wherein said headband is attached to said panels at least at the point of interconnection of adjacent panels.

* * * * *